US007152750B2

(12) United States Patent
Coffey

(10) Patent No.: US 7,152,750 B2
(45) Date of Patent: Dec. 26, 2006

(54) BABY BOTTLE COVER

(76) Inventor: Conor Coffey, 4467 Dawes St., Apt. 1H, San Diego, CA (US) 92109

( * ) Notice: Subject to any disclaimer, the term of this patent is extended or adjusted under 35 U.S.C. 154(b) by 0 days.

(21) Appl. No.: 10/923,448

(22) Filed: Aug. 20, 2004

(65) Prior Publication Data

US 2005/0040129 A1 Feb. 24, 2005

Related U.S. Application Data

(60) Provisional application No. 60/497,355, filed on Aug. 21, 2003.

(51) Int. Cl.
*A61J 9/08* (2006.01)

(52) U.S. Cl. ..... 215/11.6; 215/386; 220/737; 220/739

(58) Field of Classification Search ..... 215/11.6, 215/12.1, 12.2, 386; 150/901; 220/737, 220/739

See application file for complete search history.

(56) References Cited

U.S. PATENT DOCUMENTS

| | | | | | |
|---|---|---|---|---|---|
| 1,458,041 | A * | 6/1923 | Ferris | 215/11.6 |
| 2,035,384 | A * | 3/1936 | Ralph | 66/170 |
| 2,494,632 | A * | 1/1950 | Rodin | 248/102 |
| 2,522,381 | A * | 9/1950 | Kramer | 215/12.1 |
| 3,065,944 | A * | 11/1962 | Liebendorfer | 248/102 |
| 3,332,563 | A * | 7/1967 | Reshan | 215/365 |
| 4,514,995 | A * | 5/1985 | Curtis et al. | 66/170 |
| 4,526,280 | A * | 7/1985 | Taylor | 215/395 |
| D321,939 | S | 11/1991 | Tom | D24/199 |
| D340,991 | S * | 11/1993 | Clements | D24/199 |
| 5,871,184 | A * | 2/1999 | Kaopio | 248/102 |
| 5,927,524 | A * | 7/1999 | Miller | 215/11.6 |
| D440,828 | S * | 4/2001 | Burrus | D7/624.2 |
| D453,571 | S | 2/2002 | Hall | D24/199 |
| 6,719,138 | B1 | 4/2004 | Austin et al. | |
| 6,745,600 | B1 * | 6/2004 | Weiqing et al. | 66/194 |
| 6,772,891 | B1 * | 8/2004 | Song | 215/11.6 |
| D502,774 | S * | 3/2005 | Drumheller | D24/199 |
| 2002/0104845 | A1 * | 8/2002 | Beuke | 220/739 |

FOREIGN PATENT DOCUMENTS

GB 2265315 A * 9/1993

* cited by examiner

*Primary Examiner*—Sue A. Weaver
(74) *Attorney, Agent, or Firm*—Fish & Richardson P.C.

(57) ABSTRACT

Covers for baby bottles. A baby bottle cover includes an interior space adapted to conform to a baby bottle, an outer surface conforming to the interior space, and at least one opening adapted to receive the baby bottle. The cover may have two openings such that each opening is at opposite ends of the interior space. The interior space may be slightly larger than the baby bottle. The cover may include elastic near the openings, where the elastic forms bands; a liquid level viewing window; and/or one or more flexible materials.

10 Claims, 3 Drawing Sheets

BABY BOTTLE COVER

CROSS-REFERENCE TO RELATED APPLICATIONS

This application claims the benefit of priority from U.S. Provisional Application Ser. No. 60/497,355, entitled "BABY BOTTLE SOCK", filed Aug. 21, 2003, the disclosure of which is incorporated by reference.

BACKGROUND

The following description relates to covers for baby bottles.

Baby bottles are typically designed with a parent or guardian in mind. For example, baby bottles have been designed to be disposable and/or to include markings on the side for easy measuring of a fluids for making milk from a combination of powders and liquids—both of those features tend to be more important to a parent or guardian of a baby, than the baby herself. Many babies grab for feeding bottles but do not necessarily find the smooth texture of the bottle that interesting. They may feel around for something other than the bottle, settling for an offered finger or for an old blanket, as a comfort while being fed.

SUMMARY

Described herein are covers for baby bottles.

In one general aspect, a baby bottle cover includes one or more flexible materials substantially forming a tube adapted to at least partially envelop an outer peripheral surface of a substantially cylindrical baby bottle. That cover has at least one opening at one end of the tube such that the tube is configured to conform to the surface of the baby bottle.

Implementations may include one or more of the following features. The cover may have two openings, each opening at either end of the tube. The cover may include elastic at either end of the tube, where the elastic forms bands. The cover may include one or more segments of elastic around the tube. The tube may be adapted for a baby bottle of a specific size from a specific manufacturer. The tube may be a substantially thin tube. The circumference of the tube generally may be slightly larger than the circumference of the baby bottle. The tube may be formed such that, when placed on the baby bottle, a bottom surface of the baby bottle is left sufficiently exposed to facilitate the baby bottle being able to stand securely on its own. The cover may include a liquid level viewing window.

In another aspect, a baby bottle cover includes an interior space adapted to conform to a baby bottle, an outer surface conforming to the interior space, and at least one opening adapted to receive the baby bottle.

Implementations may include one or more of the following features. The cover may have two openings such that each opening is at opposite ends of the interior space. The cover may include elastic near the openings, where the elastic forms bands. The cover may include one or more segments of elastic around the interior space. The interior space may be adapted to conform to a baby bottle of a specific size from a specific manufacturer. The cover may be a substantially thin tube. The interior space may be slightly larger than the baby bottle. The cover may be formed such that, when placed on the baby bottle, a bottom surface of the baby bottle is left sufficiently exposed to facilitate the baby bottle being able to stand securely on its own. The cover may include a liquid level viewing window and/or one or more flexible materials.

In another aspect, a baby bottle cover includes an interior space adapted to conform to a baby bottle, an outer surface conforming to the interior space, and two openings. In that aspect, the openings are at opposite ends of the cover and at least one of the openings is adapted to receive the baby bottle.

Implementations may include one or more of the following features. The cover may include elastic near the openings such that the elastic forms bands. The cover may be a substantially thin tube. The interior space may be slightly larger than the baby bottle. The cover may be formed such that, when placed on the baby bottle, a bottom surface of the baby bottle is left sufficiently exposed to facilitate the baby bottle being able to stand securely on its own. The cover may include a liquid level viewing window.

The covers for baby bottles described here may provide one or more of the following advantages. A cover for a baby bottle may have a snug fit such that a single unit including the cover and the baby bottle does not slip from the grasp of a baby. A cover may have a tactile sensation that is more desirable than a typically smooth plastic surface of a baby bottle. The cover may have two open ends (i.e., openings) that correspond to the top and bottom of a baby bottle. Because there is an opening at one end of the cover corresponding to the bottom of the baby bottle, the single unit including a baby bottle and the cover may be more stable when standing upright than if the cover had a closed bottom. The contents of the bottle may be viewed through the opening at the bottom of a bottle, or through a window in the cover to ensure there is sufficient liquid in the bottle. Different designs may be included in the cover such that a parent or guardian may express themselves through the design of the cover, make a fashion statement, have an aesthetically pleasing bottle, and the like. The cover may include elastic to secure the cover to a bottle. The cover may be made of a machine-washable material or materials and may be removable for easy cleaning.

Details of one or more implementations are set forth in the accompanying drawings and the description below. Other features and advantages may be apparent from the description and drawings, and from the claims.

BRIEF DESCRIPTION OF THE DRAWINGS

These and other aspects will now be described in detail with reference to the following drawings.

Like reference numbers and designations in the various drawings indicate like elements.

DETAILED DESCRIPTION

Figure 1:
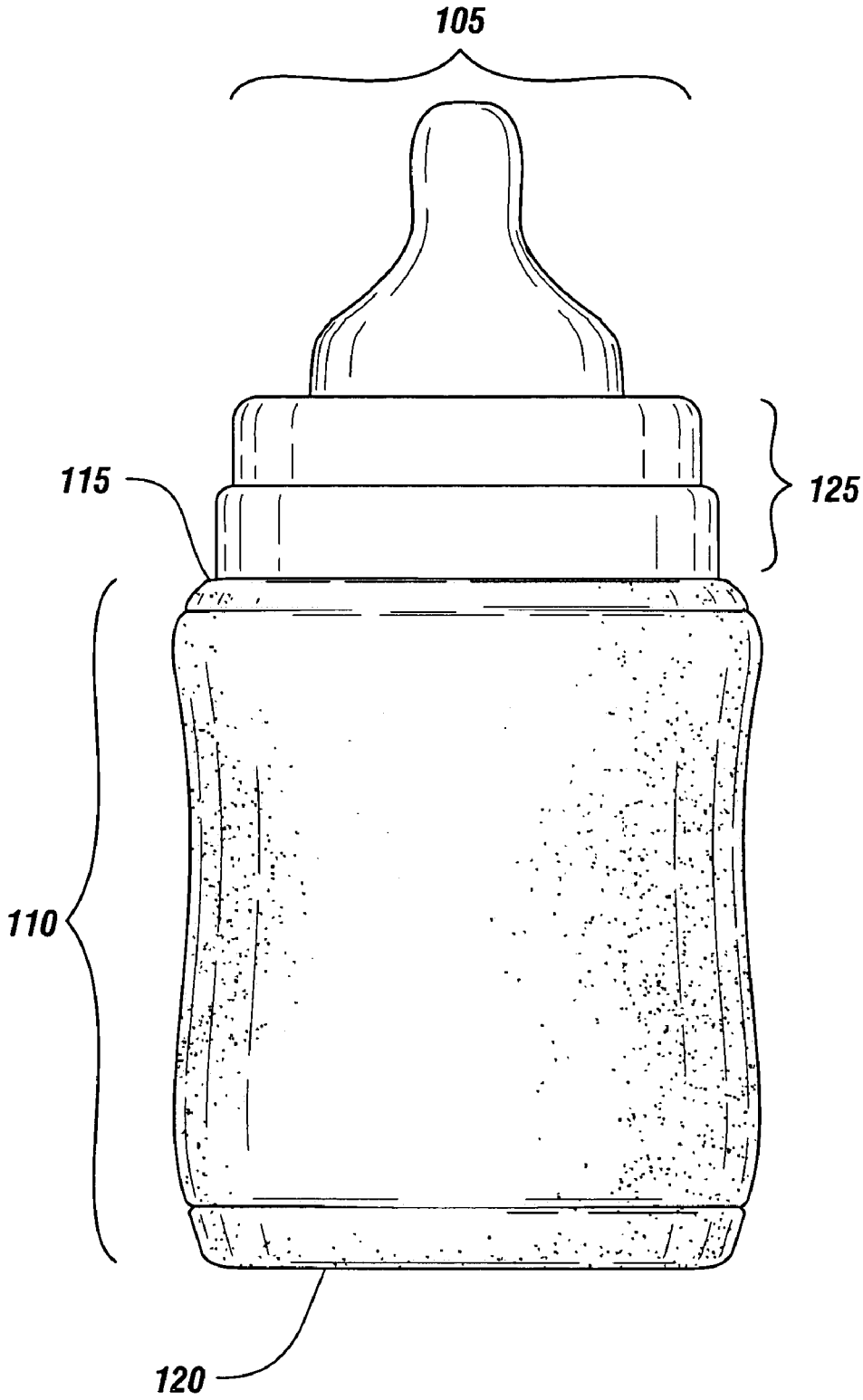
FIG. 1 depicts a baby bottle and a cover for the baby bottle.

FIG. 1 depicts a baby bottle 105 and a cover 110 for the baby bottle 105. The cover 110 is snug to the baby bottle 105 (i.e., there is substantially no slack when the cover 110 is over the baby bottle 105). To have a snug fit, the circumference of the cylinder formed by the cover 110 (which is substantially a tube) is generally slightly larger than the circumference of the cylinder formed by the baby bottle 105. The cover 110 being snug may prevent the bottle 105 from slipping and/or being dropped. Although an adult might be able to grip greater than 50% of the circumference of a cylinder formed by a single unit including the baby bottle 105 and the cover 110, from the thumb to the forefinger of a single hand, and thereby use the force between the fingers to hold the single unit, a baby typically has smaller hands, where each hand from a thumb to a forefinger may cover much less than 50% of the circumference the cylinder. Thus, when a baby attempts to hold the single unit, the compression of the thumb and forefinger creates a phenomenon whereby the single unit may be pushed away. By having a snug cover 110 and/or a surface that is easily capable of being gripped the single unit including the bottle 105 and the cover 110 may be grasped, the single unit is less likely to slip, a baby might not be forced to hold onto folds of the cover 110, and the like.

The cover 110 includes elastic at the top 115 and bottom 120 of the cover 110 (although there is a top 115 and bottom 120 of the cover 110, there need not be a defined "top" and "bottom," as the cover 110 may be symmetrical such that the top 115 and bottom 120 are identical). The elastic may make the cover 110 more snug to the bottle 105 and may ensure that the cover 110 is secure to the baby bottle 105. The elastic may be tight enough that a baby is not able to remove the cover 110, although an adult may be capable of removing the cover 110.

In alternative implementations, elastic need not be provided at both ends of the cover 110, and/or more elastic may be part of the cover 110. For example, the cover 110 may include elastic around the circumference of the cover 110 that covers the length of the cover 110, from the top 115 to the bottom 120 (e.g., similar to a legging). As another example, there may be three bands of elastic, including a first band near the top 115, a second band around the mid-section, and a third band near the bottom 120 of the cover 110. The elastic may be seamlessly enclosed in the cover 110 (e.g., as elastic material is seamlessly enclosed in a sock). In alternative implementations, elastic need not be used to secure the cover 110 to the baby bottle 105 and other types of devices and/or materials may be suitable for securing the cover 110 to the baby bottle 105. For example, Velcro fasteners may be included as part of the cover 110 and the Velcro fasteners may be used to secure the cover 110 to the baby bottle 105 and/or create a snug fit. As another example, ties (e.g., similar to the ties for a baby bib) may be used. In alternative implementations, the circumference of the cylinder formed by the cover 110 might be slightly smaller than the circumference of the cylinder formed by the baby bottle 105. In those implementations, the material or materials that make up the cover 110 might have enough give (i.e., capacity or inclination to yield under pressure) to receive the baby bottle 105 and enough resiliency such that the materials may make the cover 110 snug to the baby bottle 105.

The cover 110 is made of a fabric material similar to a blanket. This material creates a tactile sensation for a baby that may be more desirable than the tactile sensation created when a baby touches the bottle 105, as many babies do not find the smooth texture of the bottle 105 that interesting. In addition to providing a surface that creates a more interesting tactile sensation, the surface may be chosen such that the tactile sensations created by the surface of the cover 110 may be desirable because the sensations may be mentally connected to a feeling of safety. For example, the cover 110 is made of worn cotton which may be associated with an old blanket. Other materials may create a tactile sensation and may be suitable for the cover 110. As examples, depending on the qualities that are preferred for the cover 110, the cover 110 may be made of cotton (any and all cotton products such as pure cotton, cotton blend, fleece, etc.), silk, velvet, wool, and the like. The texture of the material may differ to vary a tactile sensation. As examples, the material may include ruffles or worn cotton resembling an old blanket. The cover 110 may include any combination of materials. For example, the majority of the cover 110 may be made of cotton with strips of various kinds of material incorporated. As another example, the cover 110 may include a Velcro strip upon which silk strips or a ruffle strips may be attached.

The cover 110 has a surface that may be gripped more easily than the surface of the baby bottle 105 and may absorb liquids, such as grease from hands, that may interfere with the grip of the baby bottle 105. Typically a baby bottle, such as the bottle 105, has a smooth plastic surface that is more difficult to grip than a surface such as the worn cotton surface of the cover 110, thus the cover 110 would typically be easier to grip and would absorb liquids, unlike the smooth plastic surface of the bottle 105. In alternative implementations, materials other than the cotton used for the cover 110 may be easier to grip than the surface of a baby bottle.

In addition, the material that makes up the cover 110 is a flexible material that easily shapes (i.e., not stiff). Thus, the material may be more snug to the baby bottle 105. For example, the baby bottle 105 has a mid-section that has a circumference smaller than either of the two ends of the baby bottle 105. Because, among other factors, the cover 110 is made of flexible material, the baby bottle cover 110 can snugly fit around the baby bottle 105 although the cover 110 may have a uniform circumference along the length of the cover 110.

Also, the cover 110 is thin. Having a thin cover 110 may advantageously allow the cover 110 to better shape to the bottle 105 and reduce bulkiness of the cover 110. The cover 110 being thin and/or snug may increase the ability of the baby bottle 105 and cover 110, as a unit, to be grasped (e.g., because the unit is not bulky and the cover 110 is snug, the cover 110 does not slip and is not clumsy to grasp). Other properties of the cover 110 may be advantageous. For example, the cover 110 may be made of machine-washable materials such that the cover 110 may be cleaned regardless of, for example, spills and the like that may tarnish the cover 110.

In addition to using various materials, different designs may be used that may increase the aesthetic value of the cover 110 to a baby and/or an adult. For example, an adult may use the cover 110 as a baby fashion accessory to express their personality (e.g., to express team and/or brand loyalties), and/or to make a fashion statement for themselves and/or their baby. Different designs may include the use of different colors, different themes (e.g., Hippy Baby, Happy Baby, Retro Baby, Reggae Baby, Benetton Baby, etc.), different merchandising logos and/or colors (e.g., Raiders, Cowboys, Manchester United, Liverpool, Nike, etc), and the like.

The cover 110 is adapted to fit the size of a baby bottle from a manufacturer of baby bottles that corresponds to the baby bottle 105. For example, a specific cover may be made for an Avent 4 ounce baby bottle, an Avent 9 ounce baby bottle, a Gerber 5 ounce baby bottle, and a Gerber 9 ounce baby bottle (Avent baby bottles available from Avent, Glemsford, England (Suffolk); Gerber baby bottles available from Gerber, Fremont, Minn.). Differences between the example covers may include the length, circumference of the covers, and the ranges of elasticity at the ends. The cover 110 is adapted to cover the container of the baby bottle 105 such that the top 115 of the cover 110 can be above the container and below the cap 125, and the bottom 120 of the cover 110 can be below the bottom of the bottle 105. Because the cover 110 can be located under the cap, the cap can be removed without having to remove the cover 110. Because the cover 110 has elastic on both ends and the cover 110 is longer than the straight portion of the container, the cover 110 can fit slightly over the edges of the container, like a fitted bed sheet can fit over the edges of a bed, which may better secure the cover 110 to the baby bottle 105. In alternative implementations, the cover 110 may be adapted for a one size-fits-all cover that corresponds to a single size of baby bottles across multiple manufacturers (e.g., a 9 ounce version). In alternative implementations, the cover 110 may be adapted for specific models of baby bottles from manufacturers (e.g., a specific type of 9 ounce bottle from Gerber). Although the cover 110 is adapted to cover the container of the baby bottle 105 from the top to the bottom of the container portion of the baby bottle 105, in alternative implementations, the dimensions of the cover 110 may differ and the cover 110 may still at least partially envelop an outer peripheral surface of a substantially cylindrical baby bottle. As examples, the cover 110 may be adapted to fit above the cap 125 or only to fit the middle portion of the container (i.e., not necessarily wrapping around the edges at the top and/or bottom of the container of the baby bottle 105). In alternative implementations, if the cover 110 is adapted for specific baby bottles, the bottles need not be generally cylindrical like the baby bottle 105 (e.g., a baby bottle may be in the shape of a banana), thus the cover 110 may be adapted accordingly (e.g., not a straight tube like the cover 110).

Figure 2:
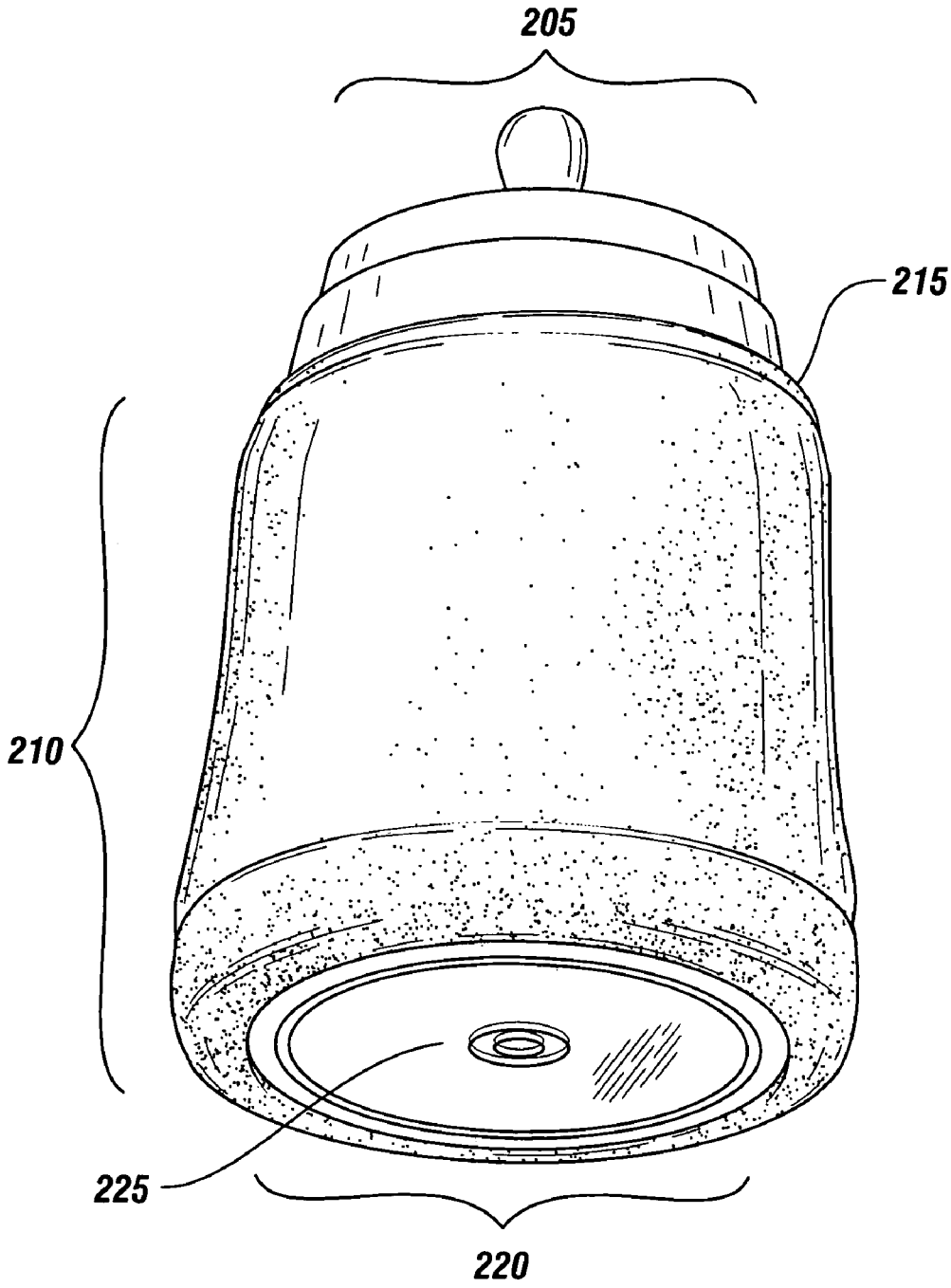
FIG. 2 depicts a baby bottle and a cover for the baby bottle.

FIG. 2 depicts a baby bottle 205 and a cover 210 for the baby bottle 205. The cover 210 may be similar to the cover 110. The cover 210 has two openings 215 and 220. The openings are at opposite ends of the cover 210 and each can be used to fit the cover 210 over the baby bottle 205. Because the cover 210 has an opening such that the bottom 225 of the baby bottle 205 may be viewed, if the bottle 205 is translucent, the contents of the bottle 205 may be checked to see if the bottle 205 is empty. Because the cover 210 has an opening for the bottom 225 of the bottle 205 and the minimal amount of material at the bottom of the cover 210 is snug to the bottom 225, the bottle 205 may stand upright easier than if the bottle 205 had a loose bottom or even a closed, snug bottom (i.e., there may be little or no material at the bottom of the baby bottle that would interfere with the ability of the bottle to stand securely on its own). If the bottle 205 and cover 210, as a single unit, can stand upright easier, the bottle 205 can be set down without having to worry about spilling contents that may be in the bottle 205 (e.g., can set down the single unit on a counter and need not hold the unit stable when filling the bottle 205). In alternative implementations, only one end may be adapted such that the cover 210 can fit over the baby bottle 205. In alternative implementations, there may only be one opening on one end. In those implementations, only the top of the cover 210 may have elastic to secure the cover 210 to the bottle 205. Also, the cover 210 may have a closed bottom, and that closed bottom may be adapted to be snug to the bottom 225 of the bottle 205. In alternative implementations, the cover 210 may include a translucent window or an absence of material to provide an area for viewing the contents of the bottle. For example, the cover 210 may include a translucent strip that runs along the length of the cover 210. Such a window may allow a user to view the contents of the bottle 205.

Figure 3:
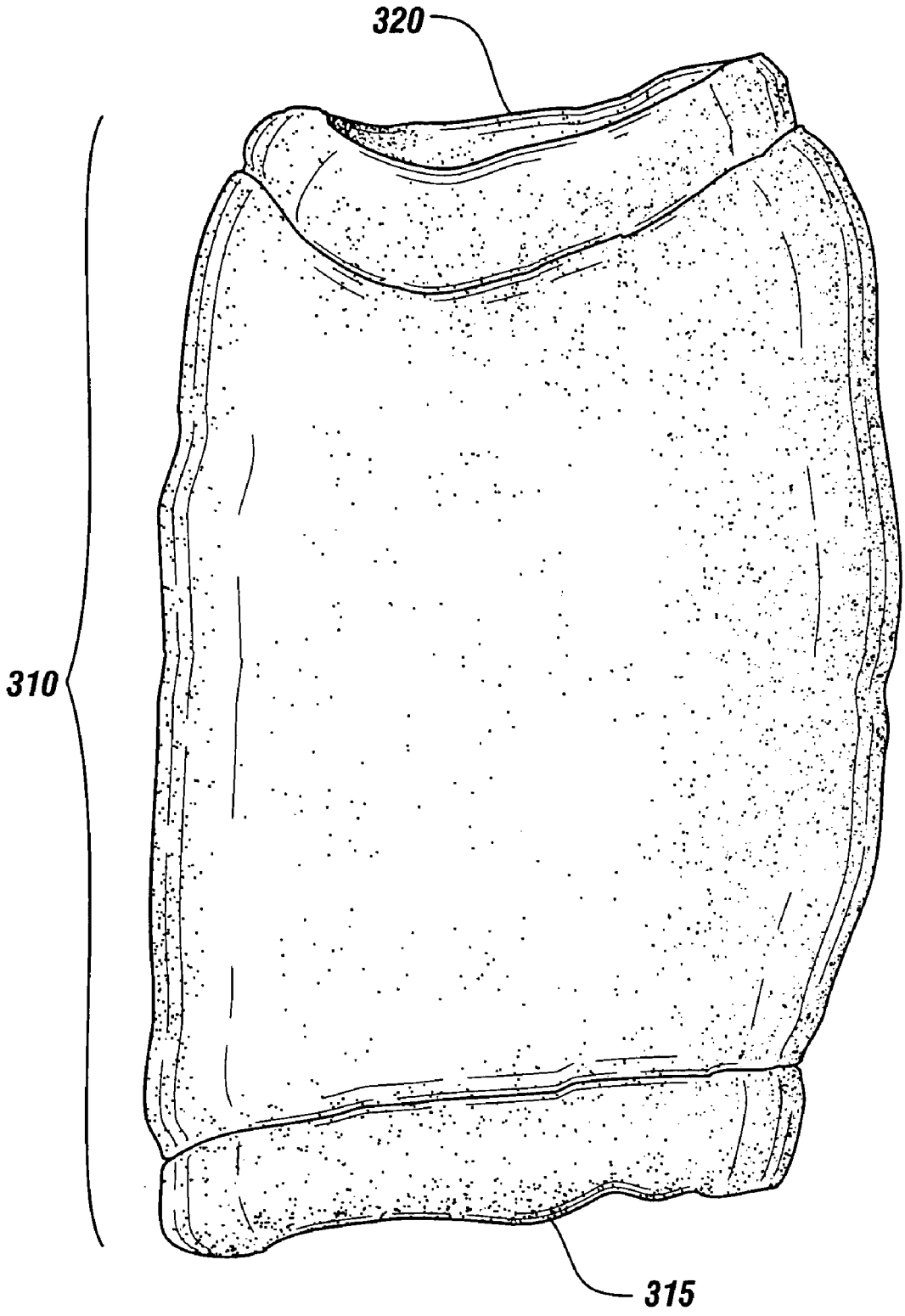
FIG. 3 depicts a cover for a baby bottle.

FIG. 3 depicts a cover 310 for a baby bottle. The cover 310 may be similar to the cover 110 and/or the cover 210. The cover 310 has an interior space adapted to conform to a baby bottle (not shown), an outer surface conforming to the interior space, and two openings (315 and 320) at opposite ends of the cover 310. Either or both of the openings 315 and 320 may be adapted such that a baby bottle can be inserted and covered by the cover 310. Near each of the two openings 315 and 320, the cover 310 has elastic that can ensure the cover 310 is secure to a baby bottle and does not slip. Although the cover 310 is made of a single layer of fabric, such that the top surface of the cover 310 conforms to the interior space of the cover 310, any number of layers of material and any type of materials may be included in the cover 310 (and substantially form a tube to envelop a substantially cylindrical baby bottle). In addition to having different layers of material, any number and type of materials may run along the length of the cover 310 (i.e., from the opening 315 to the opening 320). Although the elastic on either end of the cover 310 is a single band of elastic, in alternative implementations one or more sections of elastic may be used to secure the cover 310 to a baby bottle. Materials and/or techniques other than elastic may be used to secure the cover 310 to a baby bottle.

Thus, although a few implementations have been described in detail above, other modifications are possible. Other implementations may be within the scope of the following claims.

What is claimed is:

1. A baby bottle cover consisting essentially of:

one or more flexible materials substantially forming a tube dimensioned to snugly envelop an outer peripheral surface of a substantially cylindrical baby bottle, the cover having an opening at each end of the tube, wherein:

the tube is configured to conform to the surface of the baby bottle, end of the cover are dimensioned to fit over cylindrical ends of the outer peripheral surface of the substantially cylindrical baby bottle, a lengthwise portion of the cover which is parallel to a lengthwise portion of the tube is dimensioned to be substantially a same length as a cylinder of the baby bottle formed by a portion of the baby bottle configured to store liquid, the tube is formed such that, when placed on the baby bottle, a bottom surface of the baby bottle is left sufficiently exposed to facilitate the baby bottle being able to stand securely on its own, an inner surface of the cover is substantially parallel to an outer surface of the cover such that the tube is formed as a thin tube, at least one of the inner surface and the outer surface of the cover comprises woven material configured to provide a tactile sensation similar to a tactile sensation provided by a worn blanket, the at least one surface having a substantially uniform texture, and the outer surface of the snugly enveloping cover is capable of being easily gripped by a baby;

two elastic bands, the elastic bands integrally attached to opposite ends of the tube; and wherein the tube conforming to the surface of the baby bottle and the easily gripped outer surface of the snugly enveloping cover in combination allows the baby to grasp both the cover and the baby bottle together without having to hold onto folds of the cover.

2. The cover of claim 1, wherein the tube is adapted for a baby bottle of a specific size from a specific manufacturer.

3. The cover of claim 1, wherein the circumference of the tube generally is slightly larger than the circumference of the baby bottle.

4. A baby bottle cover comprising:

an interior space adapted to conform to a substantially cylindrical baby bottle;

an outer surface conforming to the interior space, wherein the outer surface is substantially parallel to a surface defined by the interior space such that the surfaces form a substantially thin tube, the tube is dimensioned to snugly fit over an outer peripheral surface of the baby bottle including cylindrical ends of the baby bottle, and the outer surface comprises woven material configured to provide a tactile sensation similar to a tactile sensation provided by a worn blanket;

two openings, each of the openings at opposite ends of the interior space and at least one of the openings adapted to receive the baby bottle;

two elastic bands, the elastic bands integrally attached to opposite ends of the tube, wherein the cover is formed such that, when placed on the baby bottle, a bottom surface of the baby bottle is left sufficiently exposed to facilitate the baby bottle being able to stand securely on its own; and wherein the thin, snugly fit cover and the interior space conforming to the baby bottle in combination enables a baby to grasp the cover and the baby bottle together as a single unit without having to hold onto folds of the cover.

5. The cover of claim 4, wherein the interior space is adapted to conform to a baby bottle of a specific size from a specific manufacturer.

6. The cover of claim 4, wherein the interior space is slightly larger than the baby bottle.

7. The cover of claim 4, wherein the cover comprises one or more flexible materials.

8. A baby bottle cover comprising:

an interior space adapted to conform to a baby bottle;

an outer surface conforming to the interior space, wherein the outer surface is substantially parallel to a surface defined by the interior space such that the surfaces form a substantially thin tube snugly over an outer peripheral surface of the baby bottle from a first cylindrical end to a second cylindrical end of the baby bottle, and the outer surface comprises material configured to provide a tactile sensation similar to a tactile sensation provided by a blanket;

two openings, the openings at opposite ends of the cover, at least one of the openings adapted to receive the baby bottle; and two elastic bands, the elastic bands attached to opposite ends of the tube, wherein the interior space conforming to the baby bottle, the thin tube, and the material of the outer surface in combination enables a baby to grasp the cover and the baby bottle together as a single unit without having to hold onto folds of the cover.

9. The cover of claim 8, wherein the interior space is slightly larger than the baby bottle.

10. The cover of claim 8, wherein the cover is formed such that, when placed on the baby bottle, a bottom surface of the baby bottle is left sufficiently exposed to facilitate the baby bottle being able to stand securely on its own.

* * * * *